United States Patent [19]

Curchod

[11] 4,239,209

[45] Dec. 16, 1980

[54] PUNCHING BAG SIMULATOR

[75] Inventor: Donald B. Curchod, Saratoga, Calif.

[73] Assignee: American Fitness, Inc., Woodside, Calif.

[21] Appl. No.: 963,342

[22] Filed: Nov. 24, 1978

[51] Int. Cl.[3] ..... A63B 69/24

[52] U.S. Cl. ..... 272/76; 273/55 R

[58] Field of Search ..... 272/76, 77, 78; 273/55 R, 55 A; 46/148; 270/55, 57

[56] References Cited

U.S. PATENT DOCUMENTS

| | | | |
|---|---|---|---|
| 2,237,600 | 4/1941 | Gilman | 273/55 R |
| 2,934,343 | 4/1960 | Schumacher | 273/55 R |
| 3,336,805 | 8/1967 | Austin | 273/55 R |
| 3,813,093 | 5/1974 | Taupin | 270/55 |
| 3,927,879 | 12/1975 | Long et al. | 273/55 R |
| 4,093,212 | 6/1978 | Jacques | 272/76 |

*Primary Examiner*—Richard C. Pinkham
*Assistant Examiner*—T. Brown
*Attorney, Agent, or Firm*—Flehr, Hohbach, Test, Albritton and Herbert

[57] ABSTRACT

An exercise device simulates the rebound and some of the twisting action of a speed bag by providing a V-shape body of spring material mounted by one of the arms in an inverted position with the other arm free to reciprocate and twist. A shock cord restrains the reciprocating arm from full rebound action and controls twisting movements.

2 Claims, 6 Drawing Figures

PUNCHING BAG SIMULATOR

This invention is directed to punching or speed bags for boxers and specifically concerns a mechanical speed bag simulator which affords a degree of lateral deflection and which is relatively quiet in operation as compared to prior speed bag simulators.

The speed bag is a very effective exercise apparatus for developing and maintaining hand-eye coordination skills while giving a good work out to the arms, shoulders and the upper body generally. Some skill is required to use the conventional speed bag, an inflated bag mounted to swing freely like a pendulum about a swivel. Once the skill is acquired with a conventional speed bag it is rarely lost and the use of the speed bag permits intense rhythmic exercise.

The United States patent to Leo E. Long and Edward H. Phillips U.S. Pat. No. 3,927,879 discloses a punching bag simulator which could be used by novices for the time necessary for optimum physical exercise. That apparatus had a pivot arm arranged to present the punching or target element in about the same location after each stroke of the fist and thus minimized the hand-eye coordination necessary for effective use of that apparatus. The earlier patent U.S. to Leo E. Long U.S. Pat. No. 3,813,093 disclosed a structure requiring a somewhat higher level of skill for effective use than the apparatus of U.S. Pat. No. 3,927,879. The present disclosure relates to an improved speed bag simulator which permits a range of side-to-side movement of the target and which may be easily mounted on a stationary vertical surface, and being compact is a readily useable exercise apparatus.

In summary the invention resides in a speed bag simulator comprising a resilient body having the form of a general Vee shape to define diverging arms including a support arm serving to mount the device on a vertical surface and a reciprocating arm having at one end a compressible target pad for stricking with the fists. Shock cord means are arranged between the free end of the reciprocating arm and an anchor point to restrain side-to-side and deflectiong movement of the reciprocating arm.

An important object of the invention is to provide an improved punching bag simulator which permits a side-to-side movement of the target similar to that of the speed bag.

Another object of the invention is to provide an improved punching bag simulator which returns the struck element to a pre-determined starting position after each blow.

Another object of the invention is to provide an improved speed or punching bag simulator mountable in a variety of locations and which is quieter in operation than prior simulators.

These and other objects will become apparent from the following disclosure taken in connection with the accompanying drawings.

Figure 2:
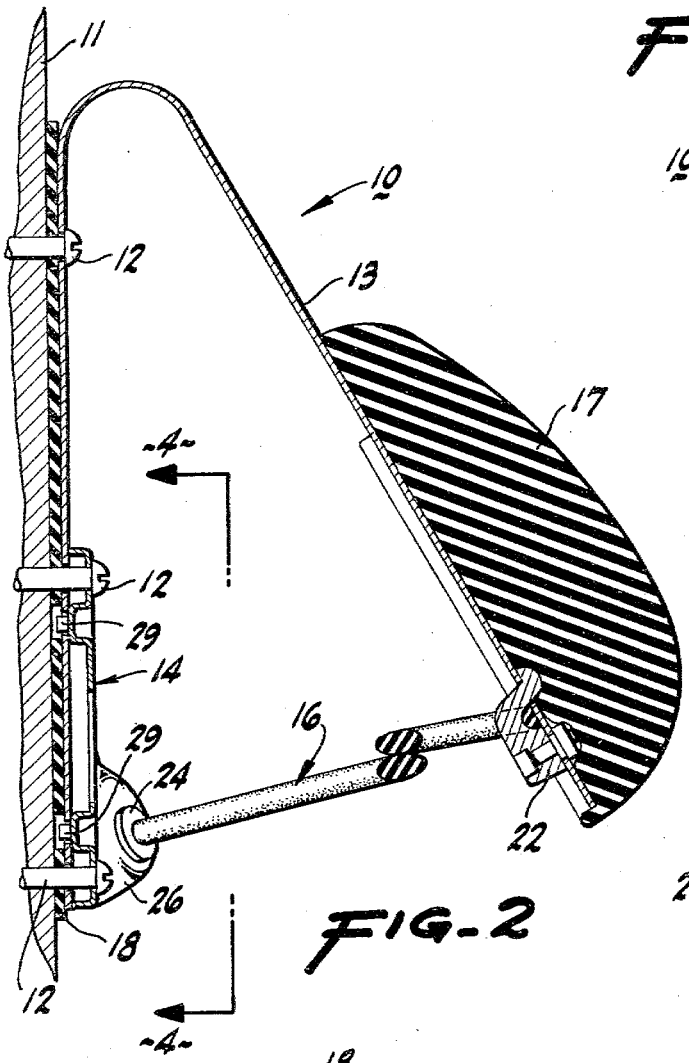
FIG. 2 is a view in the direction of the arrows 2—2 of FIG. 1.
Figure 1:
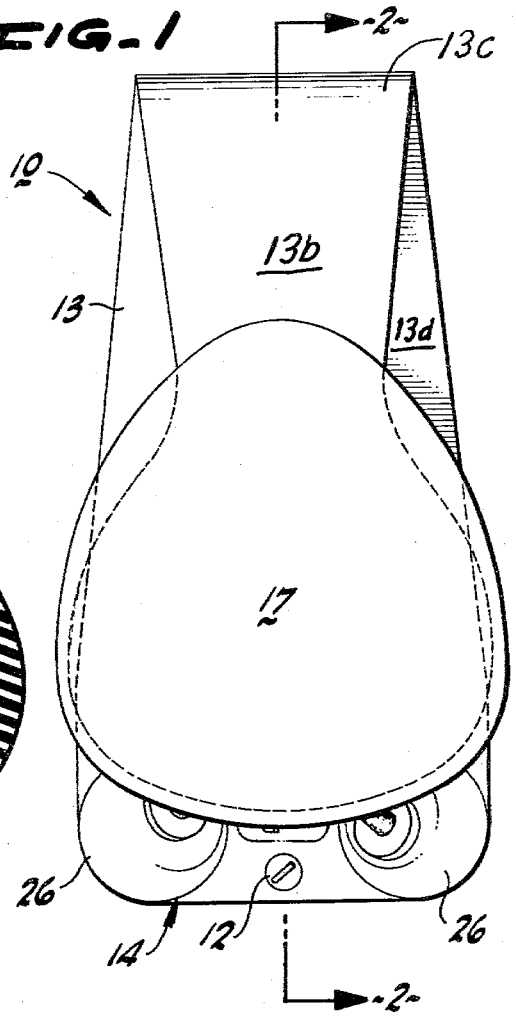
FIG. 1 is a front elevation view of the speed bag simulator according to the present invention.

A punching or speed bag simulator 10 embodying the principles of the present invention is shown in FIGS. 1 and 2 which illustrate the unit 10 operatively mounted upon a vertical supporting member 11 by the fasteners 12. The speed bag simulator 10 includes a spring plate or resilient body member 13, a hold-down or anchor member 14, a shock cord 16, and a striking or target pad 17.

More specifically, the spring plate 13 is shaped into a rounded Vee form and includes a mounting arm **13*a* and a reciprocating movable arm 13*b* joined to the mounting arm 13*a* by the intergral hinge portion 13*c*, best shown in FIG. 2. Thus, when the mounting arm portion 13*a* is secured as shown in FIG. 2, the movable portion 13*b* may be deflected and the hinge section 13*c* serves to accommodate this deflection and any twists that may be imparted to the arm 13*b*, the spring energy from the body material returning the arm 13*b*** into substantially its original position.

A layer of shock absorbing material 18, which may be comprised of rubber, cork or the like, is disposed between the mounting arm **13*a* and the vertical member 11 to dampen the vibration from the stroke and the rebound of the movable arm 13*b***.

The spring plate 13 may be fabricated from spring steel of about 19 gauge and a thickness of 0.043 inches. The hinge portion **13*c* is formed to a radius on the order of 0.88 inches and the nominal angle between the arms 13*a*, 13*b* is about 45°. After forming, the spring plate 13 may be heat treated to a value on the Rockwell "C"-scale of about 47 to 50. The free end of the movable arm 13*b* is curved or rounded to follow the general contour of the rubber striking pad 17 which is secured to the arm by adhesive or alternatively by lacing to the arm 13*b***.

The striking or target pad 17 is formed from a hard sponge rubber material having an effective, active thickness of about 2 inches. The pad 17 serves as a target for the fists and may be covered with leather to minimize the frictional abrasion with the fists or may be covered with a skin integral with the rubber material. Another type of covering of the pad 17 is a dipped, heat cured vinyl, all well known in the field. In plan the basic shape of the striking pad 17 is that of a flattened oval and it is mounted symmetrically on the end of the arm **13*b* as shown in FIG. 1**.

Figure 3:
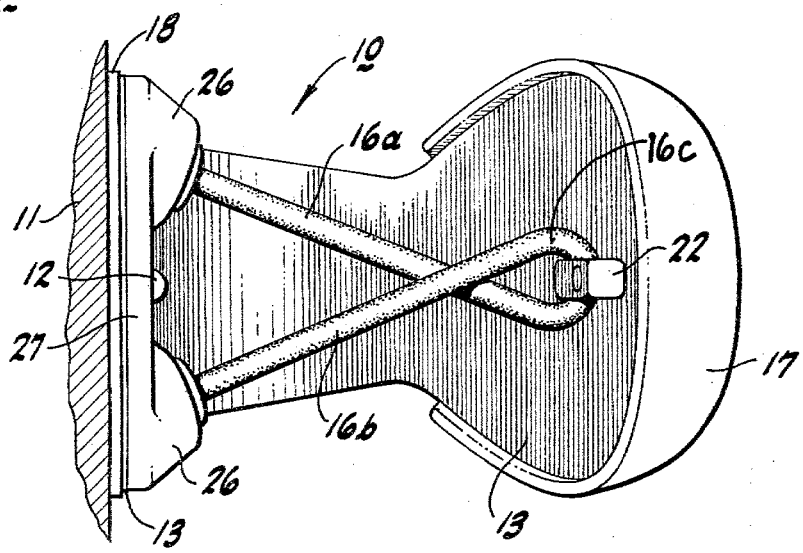
FIG. 3 is a plan view of the structure shown in FIG. 1 and taken from below.
Figure 5:
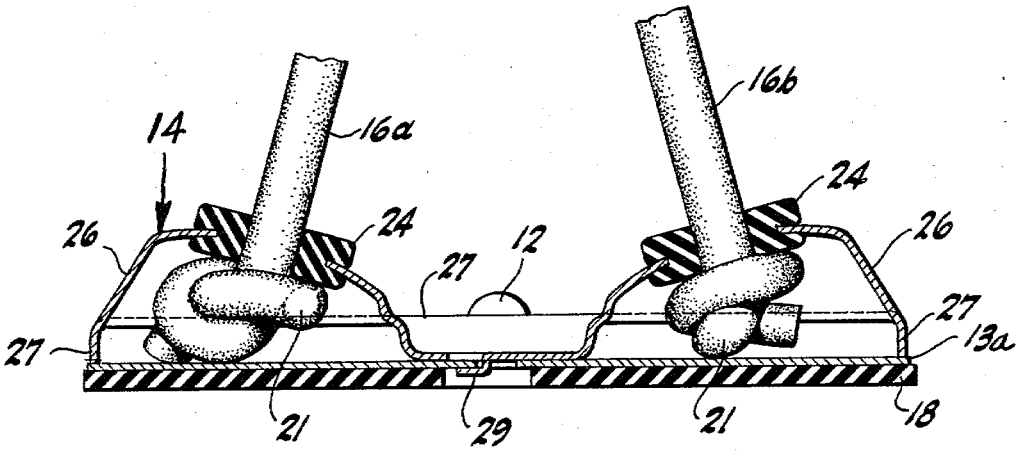
FIG. 5 is a view in the scale of FIG. 4 taken in the direction of the arrows 5—5 in FIG. 4.

The shock cord 16, as shown in FIGS. 2 and 3 serves to control lateral deflection of the arm **13*b* when struck by the fist acting on the side of the pad 17, the shock cord 16 being arranged in two strands 16*a* and 16*b* in Vee configuration and secured at the ends as shown in FIG. 5 with the knots 21 enclosed by the anchor plate 14. The ends of the shock cord are spaced apart but the central portion is formed in a loop 16*c*, FIG. 3, which is snugly secured by the clamp 22 to the side of the arm 13*b* opposite the striking pad 17. The shock cord 16 is formed from an elastomeric material of about 0.40 inches diameter and may be covered with a woven braid, not shown. The shock cord 16 co-acts with the hinge portion 13*c* of the spring plate in the static condition in that the shock cord is tensioned to bias the spring portion 13*c* preventing full free rebound of the reciprocating arm 13*b***.

A neoprene bumper member 24, FIG. 5, is arranged on the anchor plate 14 to serve to prevent metal to metal contact between the arm 13*b* and the anchor plate 14 and to minimize chafing of the shock cord against the anchor plate. The bumpers 24 also supply a solid feel to the simulator 10 when the user has deflected the arm 13*b* to the extreme position against the bumpers 24.

Figure 4:
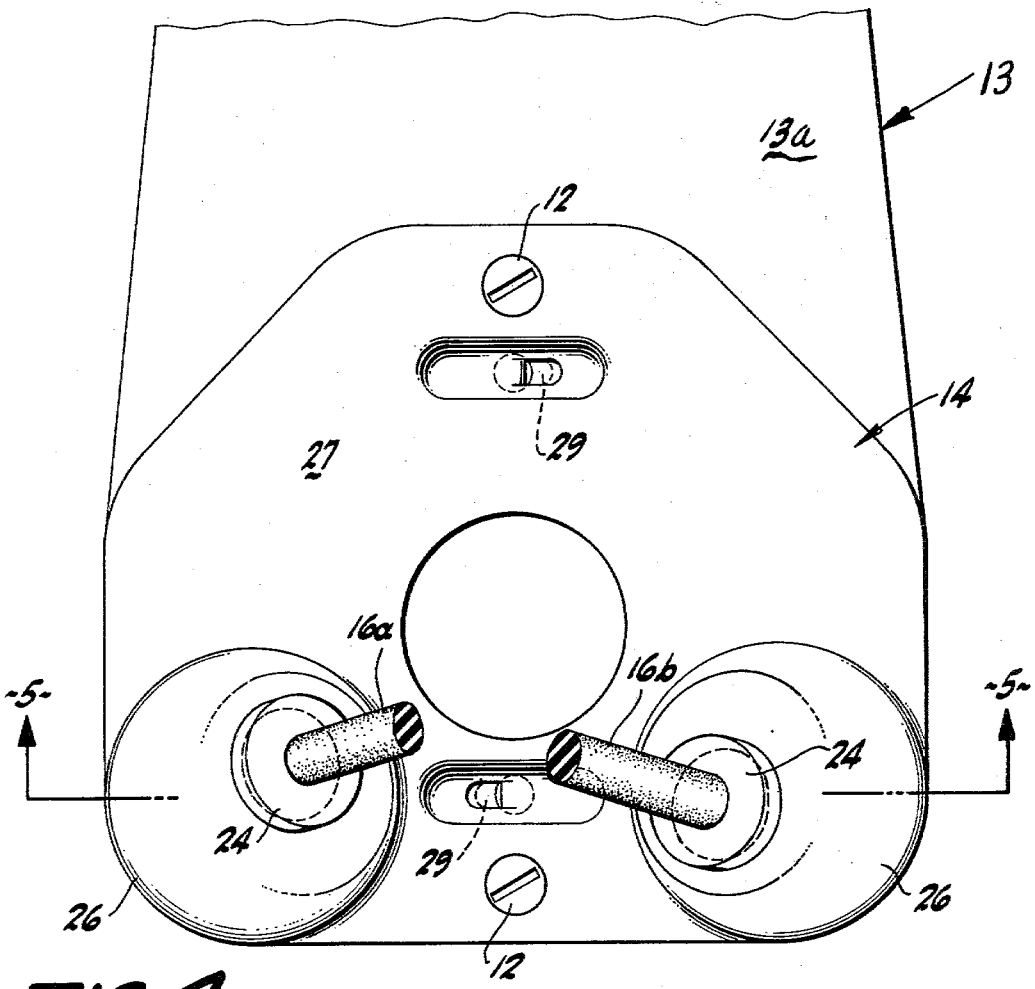
FIG. 4 is an enlarged fragmentary view taken in the direction of the arrows 4—4 of FIG. 2.

The anchor plate or hold down member 14, FIG. 4, includes the spaced housings 26 for enclosing the shock cord knots 21 and a peripheral flange 27 which engages the arm 13*a* to provide a stiff structural unit at the lower portion of the mounting arm 13*a*. Here it will be recognized that arm 13*a* and the hold down member or anchor 14 are secured to the vertical supporting member 11 along the vertical or longitudinal center line of the simulator 10. This serves to permit the lateral deflection of the movable arm 13*b* when the striking pad 17 is hit from the side as is natural with some users of a speed bag. The fastener 12 closest to the spring portion 13*c* is displaced about 2 inches from the end of the curved portion affording a further length of spring steel material for twisting and deflection in use. The width of the spring section 13*c* may be about 3 inches.

The punching or speed bag simulator 10 for operational use is first mounted upon the vertical support 11 by means of the three fasteners 12 vertically spaced apart along the center line of the unit. The preferred arrangement of the unit is with the striking pad 17 in the lower position as shown in the drawings. However, if the unit should be used for kicking as practiced in the oriental marshal arts, then the unit may be inverted with the striking pad 17 at the top or even located to one side. The insulation pad 18 is disposed between the arm 13*a* and the support for isolation of vibrations. The shock cord 16 is tensioned so as to stress the spring portion 13*c*, the hold down or anchor member 14 being secured by the clip 29 to the arm 13*a*, FIG. 5. It will be understood that the speed bag simulator 10 disclosed here is quieter in operation than the prior art units this being due to the smooth action of the spring plate 13 and the stretching action of the shock cord 16.

Figure 6:
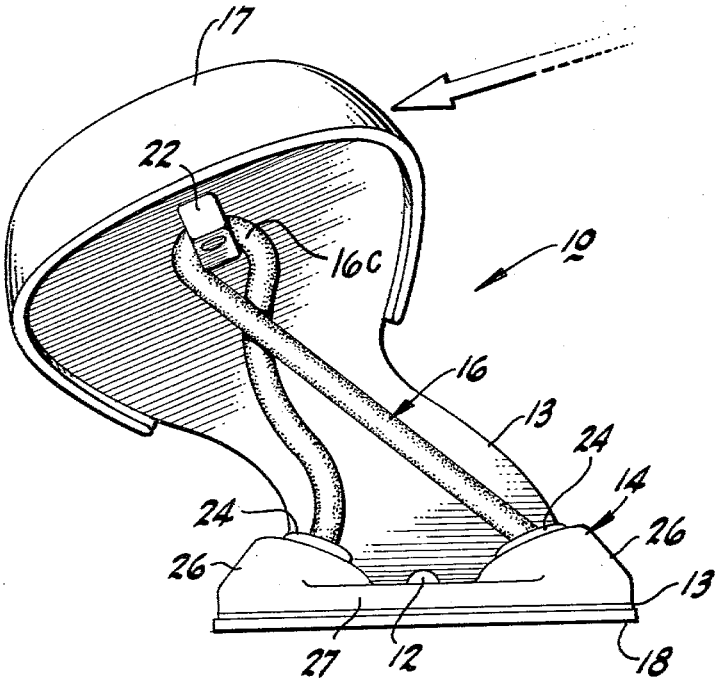
FIG. 6 is a view like FIG. 3, but on a larger scale and showing the twist and deflection of the spring unit.

Should the striking pad 17 be struck sufficiently hard to exceed the free length of increased travel of the spring arm 13*b*, the bumpers 24 will engage the arm and prevent metal to metal contact. The action of the shock cord 16 serves with the spring to return the striking pad to about its original position especially after a "twisting" blow as illustrated in FIG. 6. Thus the user may strike with his fist at the pad in about the same position. This affords a feel of the side-to-side deflection found in the authentic speed bag while yet not requiring the developed hand-eye coordination of the level obtained by skilled users of the authentic speed bag. Thus the novice may obtain the benefits of speed bag exercise by using the simulator 10 and improve his coordination while exercising his upper body. It will be seen from the foregoing that there has been disclosed a speed or punching bag simulator which fulfills all of the advantages and objects set out in the above.

What is claimed is:

1. An exercise device for simulating the action of a punching bag of a type normally hung from above to be hit to move in various directions in response thereto comprising a resilient generally V-shaped body member having diverging arms including a support arm for mounting the device upon an upright surface in an inverted Vee position, and a reciprocating arm movable between advanced and retracted positions with respect to said support arm to a degree simulating the movement of a speed bag, a compressible target pad mounted on said reciprocating arm adjacent to its free end, the arms of said body member being joined by a resilient hinge portion, said hinge portion being twistable to permit the reciprocating arm to be deflected laterally with respect to said support arm, and elastic means serving to restrain and control the rebound movement of said reciprocating arm, the last named means being connected between the free end of said arm and a stationary anchor point, said hinge portion permitting deflecting and twisting movements of said reciprocating arm so that the target pad may be struck from side-to-side by the fists in simulating the action of a speed bag.

2. An exercise device for simulating the action of a punching bag comprising a resilient body member having the form of a general V-shape to define diverging arms including a support arm serving to mount the device upon a vertical supporting surface in an inverted Vee position, and a reciprocating arm, a compressible target pad mounted on said reciprocating arm adjacent to its free end, and means serving to restrain and control the rebound movement of said reciprocating arm connected between the free end of said arm and a stationary anchor point, said body member being shaped from a resilient material and being unsupported through a substantial portion of its length permitting deflecting and twisting movements so that the target pad may be struck from side-to-side by the fists in simulating the action of a speed bag, said means serving to restrain and control the rebound movement of the reciprocating arm comprising an elastic cord fastened to said reciprocating arm and connected to said supporting arm in a tension condition restraining full rebound movement of said reciprocating arm.

* * * * *